United States Patent [19]

Kievits

[11] 4,106,140

[45] Aug. 15, 1978

[54] BODY SUPPORTING FURNITURE FRAME

[75] Inventor: Anton Kievits, Brussels, Belgium

[73] Assignee: N. V. Bekaert S.A., Zwevegem, Belgium

[21] Appl. No.: 767,965

[22] Filed: Feb. 11, 1977

[30] Foreign Application Priority Data

Feb. 18, 1976 [BE] Belgium ..... 838669

[51] Int. Cl.[2] ..... E03B 1/00

[52] U.S. Cl. ..... 5/191; 160/237

[58] Field of Search ..... 5/191, 237, 236

[56] References Cited

U.S. PATENT DOCUMENTS 3,842,452 10/1974 Kievits ..... 5/237

*Primary Examiner*—Peter M. Caun

*Attorney, Agent, or Firm*—Edward J. Brenner

[57] ABSTRACT

A body supporting furniture frame having two opposite longitudinal girders and a plurality of mutually parallel cross-girders disposed therebetween, wherein at least the edges of the cross-girders are provided with a lengthwise aperture in which a wire or bar is loosely inserted and the wires or bars are bent convexly upward in the longitudinal direction, and wherein the cross-section of each lengthwise aperture and the cross-section of the corresponding wire or bar are specially designed so that the wire or bar is blocked in the lengthwise aperture against rotation through an angle exceeding 90°.

6 Claims, 6 Drawing Figures

BODY SUPPORTING FURNITURE FRAME

BACKGROUND OF THE INVENTION

The present invention relates to a body supporting furniture frame in which parallel cross-girders are secured between two opposite longitudinal girders, and at least the edges of the cross-girders are provided with a wire or a bar which is bent convexly upward in the longitudinal direction. One such body supporting furniture frame is disclosed in U.S. Pat. No. 3,842,452 of applicant. Generally speaking, when these wires or bars are loosely inserted in the corresponding lengthwise apertures of a cross-girder and when the wires and the corresponding lengthwise apertures have, for example, a circular cross-section, then, when such a cross-girder is subjected to a considerable load, the wires may deflect in the lengthwise apertures of the cross-girder, so that the latter adopts a concave shape. To obviate this disadvantage, U.S. Pat. No. 3,842,452 provides that these wires are rigidly joined in the cross-direction of the cross-girder in at least one place. Preferably these wires are rigidly joined substantially in the center of each cross-girder. The disadvantage of this design, however, is that in making such a body supporting furniture frame, whereby the wires of each cross-girder are rigidly joined, a number of additional components and additional procedures are necessary, so that the cost and price of the frame are adversely affected. It is an object of the present invention, therefore, to obviate this disadvantage.

The present invention is directed to a body supporting furniture frame having two opposite longitudinal girders and a plurality of mutually parallel cross-girders disposed therebetween, wherein at least the edges of the cross-girders are provided with a lengthwise aperture in which a wire or bar is loosely inserted, and the wires or bars are bent convexly upward in the longitudinal direction, and includes the improvement in accordance with which the cross-section of each lengthwise aperture and the cross-section of the corresponding wire or bar are designed with a mutually cooperating structural configuration such that the wire or bar is blocked in the lengthwise aperture against rotation through an angle exceeding 90°. Preferably, the cross-section of each lengthwise aperture and the cross-section of the corresponding wire or bar are mutually adapted or designed so that the wire or bar may rotate in the lengthwise aperture through an angle between 0° and 30° only.

The present invention offers the advantage that, when such a cross-girder is subjected to a substantial load, the wires cannot deflect in the lengthwise apertures of the cross-girder. Another important advantage of the present invention is that it now becomes possible to manufacture such convexly upward bent cross-girders in a simple and inexpensive way. Thus, the plastic cross-girders can be made in a continuous manner or extruded in long sections by means of commercially available extrusion machines, after which the actual cross-girders can be sawed to the required length, for example, girders with a length of one meter. Subsequently, such a cross-girder with a suitable length is bent so that the curvature radius of the bent cross-girder is substantially equal to the curvature radius of two preliminarily bent wires or bars, so that as a result they can easily be slid into both lengthwise apertures of the cross-girder. Another advantage of the present invention is that in most embodiments the resisting moment to bending or the bending modulus I/V of the wires or bars is greater than the bending modulus I/V of wires with a circular cross-section. Since in each cross-girder these wires or bars are mainly subjected to bending, this means a better utilization of the reinforcing material.

The present invention will be further described with reference to the accompanying drawings in which.

Figure 1:
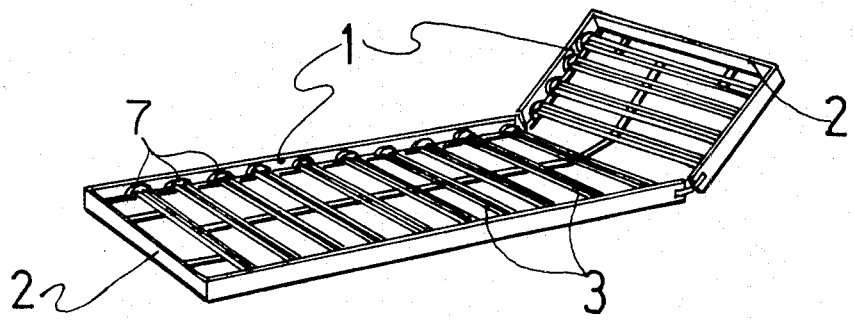
FIG. 1 is a perspective view of the body supporting furniture frame constructed in accordance with the present invention.

The framework of the two-part lying furniture frame according to FIG. 1 consists of longitudinal girders 1 and cross-girders 2. The furniture frame may also consist of more than two, say three parts, for example, a foot-end rotatable about a horizontal axis, a horizontal central part and a head rotatable about a horizontal axis. Regularly spaced parallel cross-girders 3 are provided between the longitudinal girders 1. The cross-girders 3 are preferably made of plastics and at least their edges are provided with a through lengthwise aperture 4.

Figure 2:
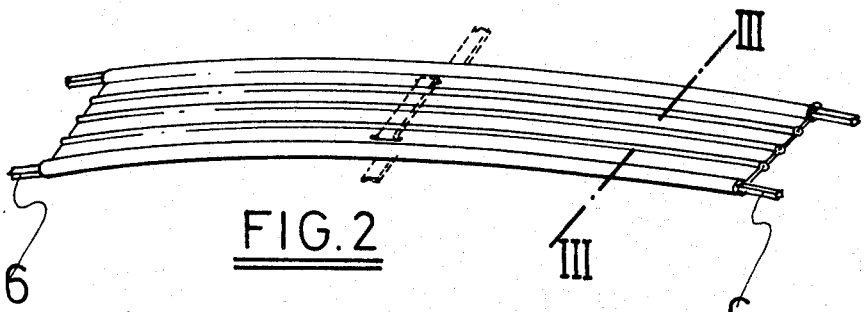
FIG. 2 is a perspective view of a special embodiment of a cross-girder of the present invention.
Figure 3:
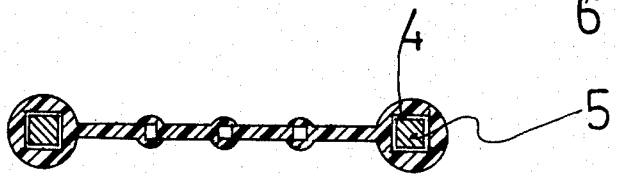
FIG. 3 is a cross-sectional view taken on the line III—III' in FIG. 2, and FIGS. 4*a*, 4*b* and 4*c* are views of additional embodiments of the cross-section of the lengthwise aperture and of the cross-section of the corresponding wire or bar constructed in accordance with the present invention.
Figure 4A:
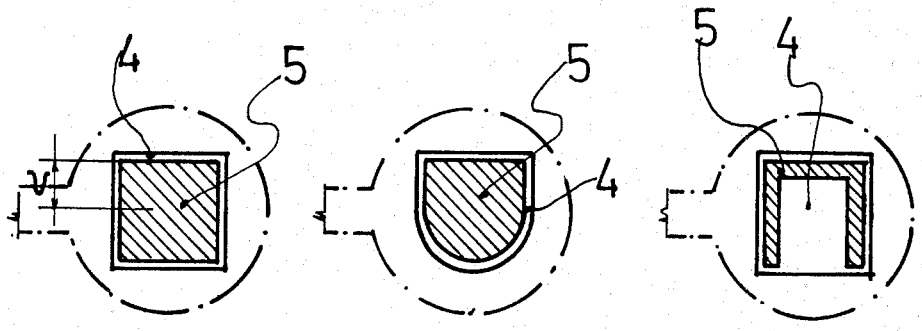

In the embodiment shown in FIGS. 2, 3 and 4*a*, the cross-girder has a lengthwise aperture 4 with a substantially square cross-section. The side of the square cross-section is for example 5 to 8 mm. FIGS. 2 and 3 illustrate that the central part of each cross-girder 3 comprises three lengthwise apertures therethrough of which the diameters are smaller than the diameters of the apertures at the edges 4. However, this central part may also be solid. The plastic cross-girders 3 may easily be manufactured by means of extrusion.

FIGS. 2 and 3 clearly illustrate that the apertures 4 of each cross-girder 3 are provided with a loosely inserted continuous wire or bar 5. The wires or bars 5 are convexly bent in the longitudinal direction and give the cross-girder 3 a convex shape, thereby considerably increasing the frame's resilience. These wires or bars 5 will preferably be made of spring wire, i.e., wire with favorable elastic properties. In the preferred embodiment as illustrated in the Figures, the free ends 6 of the convexly bent wires 5 form a tenon for a tenon and mortise joint, for example, by means of resilient supports 7, which are mounted on the longitudinal girders 1.

In order to prevent deflection under the load of the body supporting frame structure of the wire 5 which is convexly bent and loosely inserted in a lengthwise aperture 4, the cross-section of wire 5 is adapted to the cross-section of the corresponding aperture 4, so that the wire or bar 5 in the lengthwise aperture 4 is blocked against rotation. In the cross-girder 3 shown in perspective in FIG. 2, the corresponding cross-section shown in FIG. 3, and the larger-scale cross-section of the aperture 4 and the corresponding wire 5 shown in FIG. 4*a*, the cross-section of the aperture 4 and the cross-section of the wire 5 are square and substantially equal. The side of the cross-section of the aperture 4 is, for example, 8 mm., whereas the side of the cross-section of the wire 5 is, for example, 7 mm.

When such a cross-girder 3 is subjected to a substantial load, so that the convexly upward bent girder 3 is substantially horizontal or even deflected downward, then after eliminating the load, this cross-girder 3 will readopt its convexly upward bent position, since the wire 5 is only able to rotate through a small angle in the lengthwise aperture 4. To prevent deflection of the wire 5 in the lengthwise aperture 4 during loading, care should be taken that the dimensions of the cross-sections of the wire and the aperture are such that the possible angle of rotation of the wire 5 in the aperture 4 during loading is less than 90°. The diameter of the largest possible internal circle in a square with a side of 8 mm. also is 8 mm. The diameter of the circle which goes through all the corners of a square with a side of 7 mm. equals $\sqrt{98}$ or $\pm 9.9$ mm. Thus, it is clear that a similar wire 5 is not able to rotate in the lengthwise aperture 4. For a wire with a square cross-section with a side of 6 mm., the diameter of the circle going through all the corners of the square is equal to $\sqrt{72}$ or $\pm 8.5$ mm. or larger than 8 mm. This means also that a similar wire cannot rotate in the lengthwise aperture through an angle exceeding 90°.

It would also be possible to dispose in the lengthwise aperture 4 a wire 5 with a cross-section other than a square, for example, a wire with a regular hexagonal cross-section, a rectangular cross-section, etc. To prevent the wire 5 from rotating in the aperture 4 through an angle exceeding 90°, the condition must also be fulfilled that the diameter of the circle going through all the corners of a regular hexagon, rectangle, be larger than the diameter of the largest possible internal circle in the cross-section of the aperture 4. This also holds for a wire 5 with a square cross-section in a lengthwise aperture 4 with a regular hexagonal, rectangular cross-section. This means that the lengthwise aperture 4 and the wire 5 may have any cross-section and that the biggest dimension of the cross-section of the wire 5 must be considerably bigger than the smallest dimension of the cross-section of the lengthwise aperture 4.

The choice of a shape, for example a square, for the cross-section of the lengthwise aperture 4 and, in particular, of the wire 5 depends upon several factors, such as the manufacturing cost of this type of profile wire, the resisting moment to bending or the bending modulus, etc. Thus, a wire with a square or rectangular cross-section can be made in a relatively simple manner or is available on the market. The bending modulus of a wire with a square cross-section and with a side A in respect of an axis going through the center of gravity and parallel to the base is equal to $A^3/6$. In contrast, the bending modulus of a wire with a circular cross-section and with a diameter D is equal to $\pi D^3/32$, or, in other words, this means that the bending modulus of a wire with square cross-section is bigger than the bending modulus of a wire with circular cross-section when the surfaces of both cross-sections are equal to each other or when $A^2 = \pi D^2/4$.

In case of a lengthwise aperture 4 with a square cross-section with a side of 8 mm., for example, it would also be possible to use a wire or bar 5 consisting of a central portion with a square cross-section and with a side of 7 mm. for example, and two extremes with a circular cross-section and with a diameter of 7 mm., for example. It is clear that this wire or bar 5 consisting of a combination of different successive profiles is also blocked in the lengthwise aperture 4 against rotation through an angle exceeding 90°.

FIGS. 4*b* and 4*c* show two other embodiments of cross-sections of the aperture 4 and the corresponding wire or bar 5. FIG. 4*b* shows an aperture 4 and the corresponding wire 5 with D-shaped cross-section or a cross-section consisting of a half-circle and an adjacent rectangule. FIG. 4*c* shows an aperture 4 with square cross-section in which a U-profile is slid.

What is claimed is:

1. In a body supporting furniture frame having two opposite longitudinal girders and a plurality of mutually parallel cross-girders disposed therebetween and wherein at least the edges of the cross-girders are provided with a lengthwise aperture in which a wire or bar is loosely inserted, and said wires or bars are bent convexly upward in the longitudinal direction, the improvement in accordance with which the cross-section of each lengthwise aperture and the cross-section of the corresponding wire or bar are designed with a mutually cooperating structural configuration such that the wire or bar is blocked in the lengthwise aperture against rotation through an angle exceeding 90°.

2. A body supporting furniture frame as set forth in claim 1 wherein the cross-section of each lengthwise aperture and the cross-section of the corresponding wire or bar are designed with a mutually cooperating structural configuration such that the wire or bar in the lengthwise aperture is only able to rotate through an angle between 0° and 30°.

3. A body supporting furniture frame as set forth in claim 1 wherein the cross-section of said lengthwise apertures and said corresponding wire or bar are substantially square shaped.

4. A body supporting furniture frame set forth in claim 3 wherein the two cross-sections are substantially equal.

5. A body supporting furniture frame as set forth in claim 1 wherein the cross-sections of said lengthwise apertures and said corresponding wire or bar are substantially D-shaped.

6. A body supporting furniture frame as set forth in claim 1 wherein the cross-section of said lengthwise apertures is substantially square-shaped and the cross-section of said corresponding wire or bar is substantially U-shaped.

* * * * *